United States Patent [19]

Bertesi et al.

[11] Patent Number: 4,652,165

[45] Date of Patent: Mar. 24, 1987

[54] COMPUTER PRINTOUT AND DOCUMENT HOLDING DEVICE

[75] Inventors: Ezio Bertesi; Marco Bertesi, both of Carpi, Italy

[73] Assignee: Cartoplast Bertesi S.p.A., Capri, Italy

[21] Appl. No.: 661,677

[22] Filed: Oct. 17, 1984

[30] Foreign Application Priority Data

Oct. 19, 1983 [IT] Italy ..... 40099 A/83

[51] Int. Cl.[4] ..... B42F 3/00; B42F 15/04; A47B 63/00

[52] U.S. Cl. ..... 402/4; 312/184

[58] Field of Search ..... 312/184; 402/4, 60, 402/68

[56] References Cited

U.S. PATENT DOCUMENTS

| | | | |
|---|---|---|---|
| 3,503,695 | 3/1970 | Giampa | 402/68 X |
| 4,056,296 | 11/1977 | Hedstrom et al. | 312/184 |
| 4,171,854 | 10/1979 | Hedstrom et al. | 312/184 |

FOREIGN PATENT DOCUMENTS

| | | | |
|---|---|---|---|
| 753894 | 3/1967 | Canada | 312/184 |
| 1207336 | 12/1965 | Fed. Rep. of Germany | 312/184 |
| 1761772 | 8/1971 | Fed. Rep. of Germany | 402/4 |

*Primary Examiner*—Paul A. Bell

*Attorney, Agent, or Firm*—Brumbaugh, Graves, Donohue & Raymond

[57] ABSTRACT

On a beam which constitutes the body of the sheet material holding device, are slidingly mounted, by means of prismatic coupling with wings of the beam profile, one or more hook brackets for hanging the beam to mounting bars which are disposed in suspension filing systems and, respectively, at least two material holding forks by prismatic coupling with wings opposite to the wings with respect to the core of the beam profile. Locking means consisting of a screw, apt to lock the hook bracket to the beam, are on each bracket, and retaining means, generally by friction, are provided between each holding fork and he beam, to prevent the forks from indesirably moving under the effect of the weight of the bound sheet materials.

8 Claims, 21 Drawing Figures

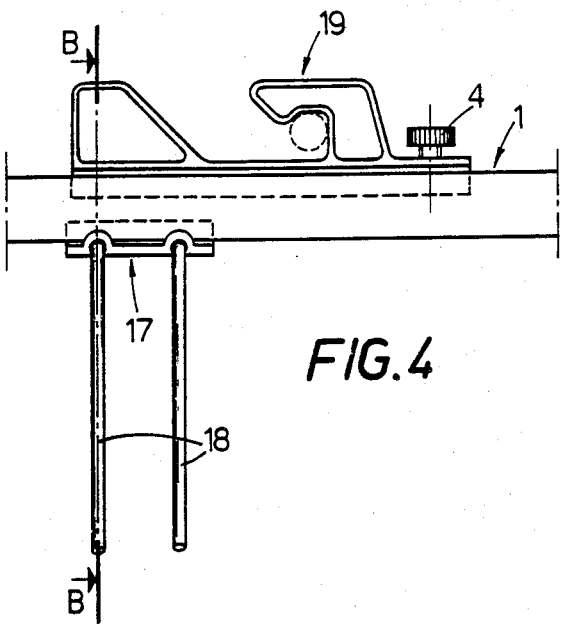
FIG. 4
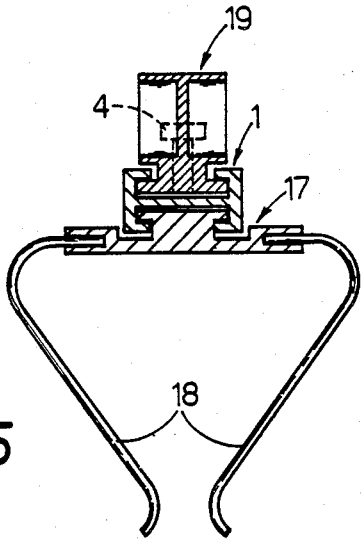
FIG. 5
FIG. 6
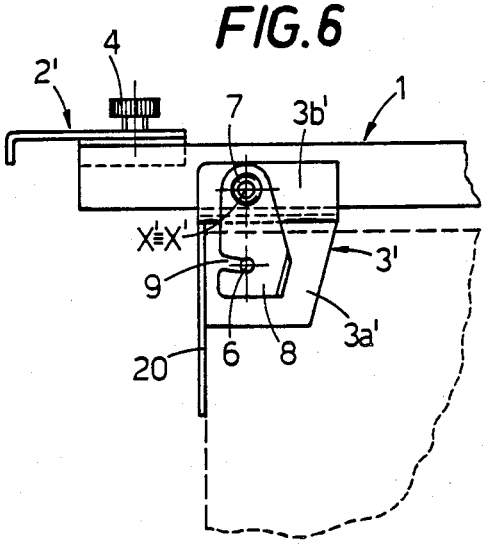
FIG. 7
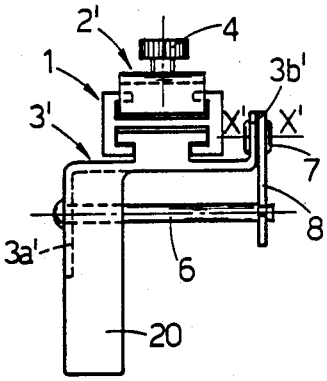

FIG. 8a
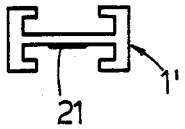
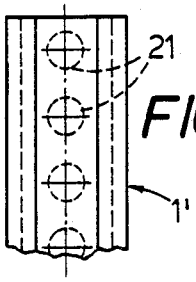
FIG. 8a'
FIG. 8b
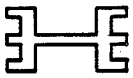
FIG. 8c
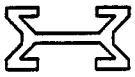
FIG. 8d
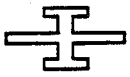
FIG. 8e
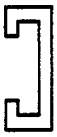
FIG. 8f
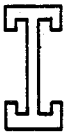
FIG. 13
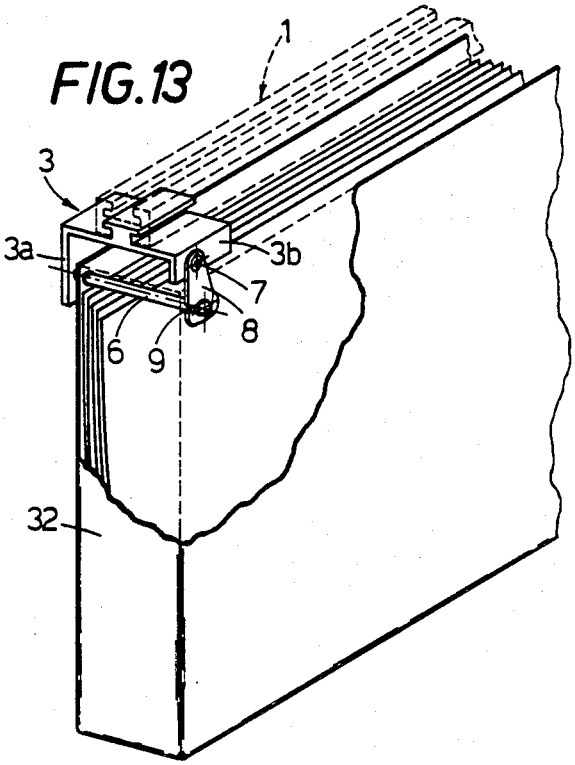
FIG. 8g
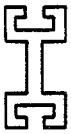
FIG. 8h
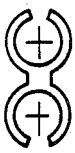

COMPUTER PRINTOUT AND DOCUMENT HOLDING DEVICE

FIELD OF THE INVENTION

This invention relates to a device for holding sheet materials which are already bound such as computer printouts, catalogue or booklet pages, and for removably binding loose-leaf sheet materials, e.g. of documents, leaflets, etc.

BACKGROUND OF THE INVENTION

Document holders of this type which are designed for use in suspension filing systems are well known in the prior art. For example, see particularly the devices described in U.S. Pat. No. 4,056,296, U.S. patent application Ser. No. 741,237, and U.S. Pat. No. 4,171,854. These references disclose improved embodiments of a document holder comprising a body shaped like a back or spine of a book. The body is formed by two similar sections which are permanently connected together so that they can be swung toward and away from one another, at least two mounting pins which are suitable for holding and positioning sheet materials between the two sections, and spring-locking means apt to prevent rotation of the two sections and the release of the sheet materials, which are captivated through their holes on the mounting pins between the two sections of the holder. In this position, portions, which are suitably, symmetrically shaped on both sections of the holder form hooking means for mounting the holder on rails or similar supports provided in suspension filing systems.

A first drawback of the above mentioned devices results from the structure thereof. Since the holder body is made as an integral unit, mutual rotation of the two body sections is obtained by longitudinally weakening the body in its narrow central strip-shaped portion so that a hinge is formed. Although this hinge is easy to make, it obviously tends to break after repeated opening and closing operations of the document holder, thus putting the holder out of use. Furthermore, the hooking means are provided in fixed positions on the body of the holder, whereas the distance between the supports is not always the same from one suspension filing system to another.

Therefore, it is necessary to produce document holders having different lengths.

Since it is desiderable to adjust the document holders to the amount of sheet materials to be contained, it is necessary to design them with different transversal dimensions. Furthermore, the above mentioned holders are not able to hold sheet materials without holes for the mounting pins. It should also be be pointed out that it is impossible to put such holders which are designed to be placed into a suspension filing system into cabinets.

SUMMARY OF THE INVENTION

The invention is intended to remedy these drawbacks by providing a holding device comprising a beam—preferably a thermoplastic section constituting the body of the device—hooking elements for hanging the device on bars of suspension filing systems, and holding means capable of removably holding the documents to be filed, both the hooking elements and the holding means being fitted and positioned as interchangeable fittings into sliding guides provided in the beam.

The characteristics of mobility and interchangeability of the hooking elements and holding means fitted on the compact, structurally simple and easy operating body, give at least the following appreciable advantages to this device:

the device can be used both in cabinets and in suspension filing systems;

it can be manufactured in a uniform length, since it is possible to adjust the hooking elements according to any distance between the mounting bars;

the device is suitable to receive sheet materials provided with both conventional holder holes and sprocket holes of computer printouts, independently of the distance between the holes;

further, the device is suitable to receive sheet material without holes; and the documents can be examined without previously removing their pages from the device itself.

BRIEF DESCRIPTION OF THE DRAWINGS

These and other advantages and characteristics of the invention will become more evident the following description, by way of illustrating, but not limiting, examples of some embodiments thereof, with reference to the attached drawings in which:

FIG. 4 is a partial front view showing fittings arrangeable in the device of FIG. 1;

FIG. 5 is a cross-section view taken along line B—B of FIG. 4;

FIG. 6 is a partial front view showing modified fittings compared to those of FIG. 1;

FIG. 7 is a side view of the device of FIG. 6;

FIGS. 8*a*–8*h* are cross-section views of alternative beams compared to the beam represented in FIG. 1;

FIG. 8*a'* is a partial top plan view of the beam in FIG. 8*a;*

FIG. 13 is a partial perspective view of collecting means for sheet materials without holes.

DETAILED DESCRIPTION OF THE PREFERRED EMBODIMENTS

In the several views, like numbers are used to designate like parts and elements.

Figure 1:
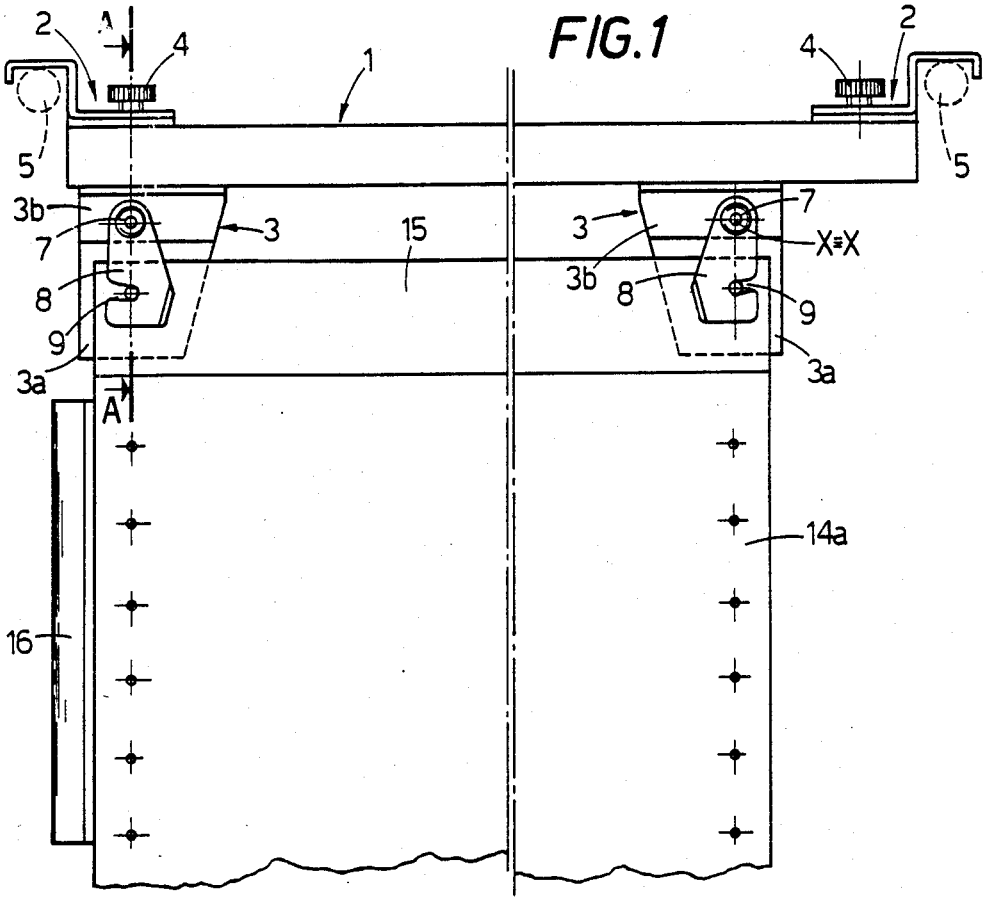
FIG. 1 is a partial front view of a first embodiment of the device.
Figure 2:
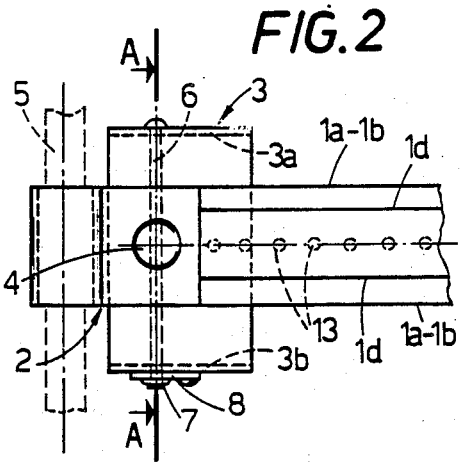
FIG. 2 is a partial top plan view of the device of FIG. 1.
Figure 3:
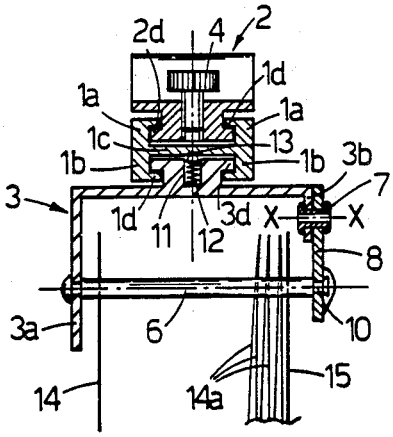
FIG. 3 is a partial cross-section view taken along line A—A of FIG. 1.

Referring first to FIGS. 1–3, a plastic beam, which is preferably obtained from a structural shape or by molding and constitutes the body of a holding device according to the present invention, is indicated as 1. The beam 1 has a double channel defined by pairs of wings 1*a* and 1*b*, joined by a core 1*c*. The wings, by means of their opposite edges 1*d*, form sliding guides on a side of the beam (i.e. the upper one when the holder is placed in a suspension filing system or the like) for at least a pair of hook brackets 2, and on the other side (i.e. the lower one) for at least a pair of sheet material holding forks 3, respectively. Both the hook brackets 2 and the holding forks 3 are inserted in the beam ends and are slidable on the the guides formed by the beam 1 due to their cross-sectional shape, which in a joining zone is a T, and an inverted T respectively. The end edges 2*d* and 3*d* of the hook brackets 2 and the holding forks 3 are positioned in the beam undercuts, formed by the corresponding edges 1*d*.

Each hook bracket 2 has a step shaped front, bent down at his free end. The body of the hook bracket is provided with a threaded hole for a locking screw 4, which acts as an adjustable stop for the hook bracket 2. It is obvious that, by screwing screw 4 until it comes in contact with the beam core 1*c*, the hook bracket 2 is slightly raised and, as a result of forced friction between the facing surfaces of the edges 1*d* and 2*d*, is prevented from moving. The hook brackets 2 are designed to be placed on mounting bars, schematically shown and indicated by 5, which are disposed within the suspension filing system.

Each sheet material holding fork 3 acts as a support having at both ends of its T-shaped portion, opposite arms 3*a* and 3*b*, which are bent downwards. A pin 6 is transversely mounted on the arm 3*a*, and a hook 8 is pivoted on arm 3*b*, which is shorter than arm 3*a*, by means of a rivet 7 around an axis X—X which is parallel to the axis of pin 6. The hook 8 being provided with a slot 9 so positioned that the hook can engage by this slot a thin end portion of pin 6. Forks with various dimensions can be provided in order to suitably hold various amounts of sheet materials. Further, each fork 3 is provided with a spring-ball retaining unit 12 in a central cavity 11 thereof facing the lower surface of the beam core 1*c*; the ball is designed to be housed in one of the hemispherical notches 13 which are longitudinally provided in the lower face of the beam core 1*c*. In order to permit a fork to travel along the beam, the fork must be pressed against the beam, thus reducing the friction between the corresponding surfaces of edges 1*d* and 3*d*. When the fork is disposed so that pins 6 penetrate the thereto coaxial holes of documents or computer printouts and hook 8 is locked on pin ends 10, the retaining unit 12 counteracts the effect of the weight of sheet materials, which would cause both forks 3 to come closer each other and sheet materials to be bent.

In order to remedy this drawback, in case the documents to be held are lacking covers, stiff, e.g. cardboard, covers 14 with reinforced edges 15 can be provided, as shown in FIG. 1, for the computer printouts 14*a*. Further, the reinforced edge can desirably consist of a punched metal tape (not shown), which is folded around the cover edge. A well known distinctive element for computer printouts is indicated as 16 in FIG. 1.

With the same purpose of reducing the sheet material bending, at least one sheet centering gripper 17, as shown in FIGS. 4 and 5, can be provided on the lower guide of the beam. Gripper 17 is coupled to the beam by means similar to those of the hook brackets and the holding forks. The gripper 17 a body of thermoplastic material and, at both ends of this body, a set of leaf springs 18, made of steel wire or strip. Centering gripper 17 can also be molded as an integral unit of thermoplastic material. A number of springs 18 can be pivoted to the body, to facilitate the insertion and the removal of sheet materials.

In FIGS. 4 and 5 is shown a hooking means 19 provided so as to hang the holder in a suspension filing system having only one mounting bar. This hooking means, per se known in the art, is here movable by virtue of the prismatic coupling with the guides constituted by the beam, as already described with reference to the hooking means 2.

Two modified embodiments 2' and 3' of the hook bracket and the sheet material holding fork, respectively, are represented in FIGS. 6 and 7 with the purpose of reducing the overall dimension of the holder. In particular, a step section is not provided in the hook bracket 2'. In the holding fork 3' the arm 3*b'*, different from fork arm 3*b* of the first embodiment, is turned upwards, instead of downwards, and accordingly also the pivoting axis X'—X' between hook 8 and arm 3*b'* is raised.

Further, a label plate 20 for identifying the holder is shown as integral with the holding fork 3'.

FIGS. 8*a*, 8*a'*, 8*b*, 8*c*, 8*d*, 8*e*, 8*f*, 8*g*, and 8*h* represent possible alternative cross-section shapes different from the one of the first embodiment.

Figure 9:
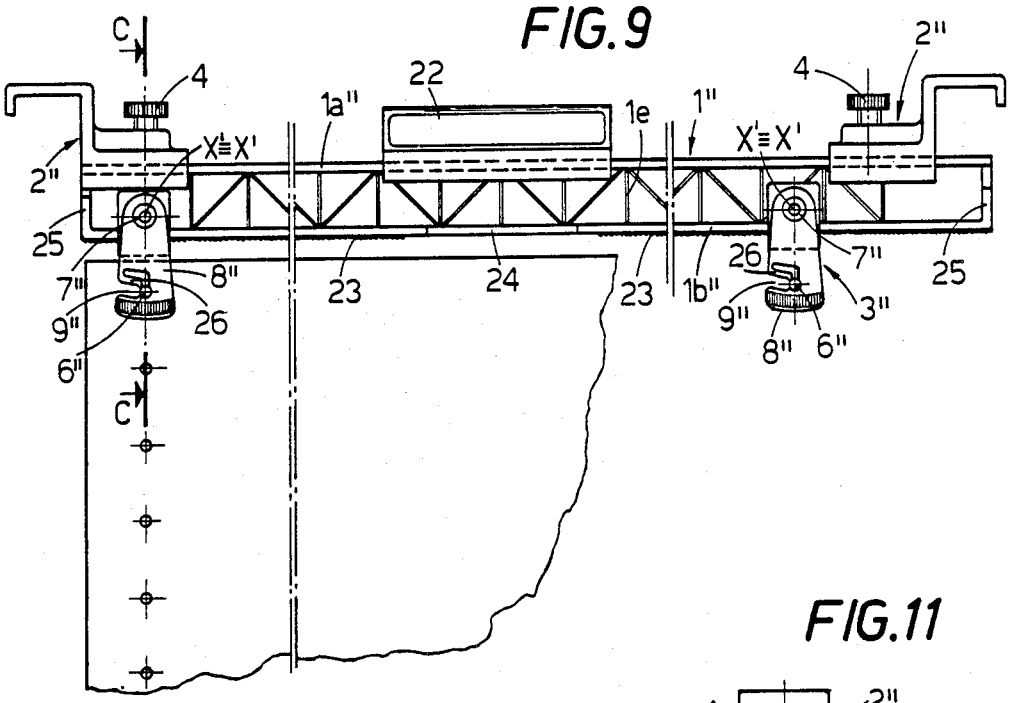
FIG. 9 is a front view of another embodiment of the device.
Figure 11:
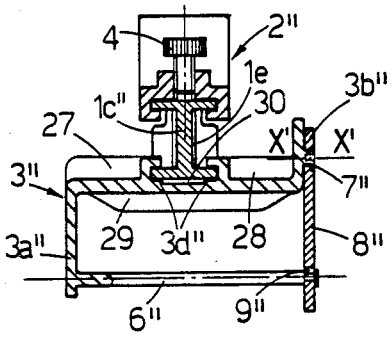
FIG. 11 is an enlarged cross-section view taken along line C—C of FIG. 9.
Figure 10:
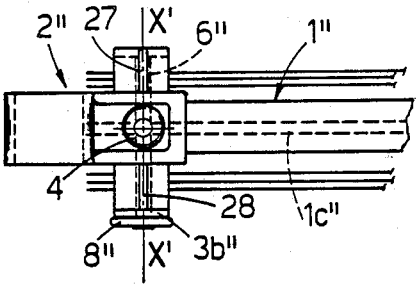
FIG. 10 is a partial top plan view of the device in FIG. 9.
Figure 12:
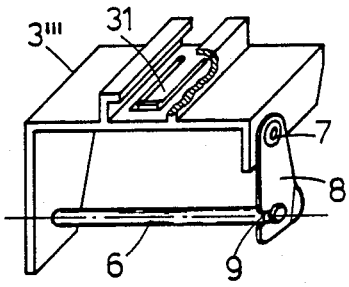
FIG. 12 is a perspective view of a sheet material holding means modified compared to that shown in the embodiment of FIG. 9.

Cylindrical projections 21, instead of the hemispherical notches of the first embodiment, can be provided in any one of the embodiments of the beam 1. The prismatic couplings with the hook brackets and the holding forks, which are accordingly different from the above described couplings, are not explained for the sake of brevity. Another embodiment of the holder according to the present invention is shown in FIGS. 9–11. The holder body is an I-beam 1'', the core 1*c''* of which is stiffened by bracings 1*e*. Hooking means 2'', which are different from the hooking means of the first embodiment, having a channel for coupling with beam 1'', are fittable into wings 1*a''*. A hooking means, similar to the one, 19, shown in FIGS. 4 and 5, and a label element 22 can also be fitted into the upper wings 1*a''*. On its external surface, the lower wings 1*b''* of the beam 1'' are provided with transverse knurls 23, except a central section 24 thereof, where the wings are notched to permit the fitting of sheet material holding forks 3'' on the lower guide, i.e. on the beam wings 1*b''*. At the beam ends, the lower guide has ledges 25 to prevent the forks from getting out from the guide itself. Forks 3'' structurally and functionally differ from forks 3' shown in FIGS. 6 and 7, as well as in the coupling with the beam. Each holding fork 3'' consists only of two molded parts. One of these, i.e. the support, comprises a downward bent arm 3*a''* and an upward bent arm 3*b''*, which are integral with the respective ends of the horizontal section of the support itself having the prismatic coupling with edges 3*d''*, and a pin 6'' integral with arm 3*a''*. The other part of the holding fork 3'' is a hook 8'', in the slot 9'' of which a resilient latching tab 26 is provided; the hook 8'' is pivoted round the axis X'—X' by rivetting a stud 7'', which is formed in arm 3*b''* for such a joining. Fork 3'' has lower dimensions than fork 3' owing to transverse stiffening ribs 27, 28 and 29. A thin bar 30 transversally projecting on fork 3'' in the joining zone between the edges 3*d''* can prevent the fork from moving with respect to the knurled wings 1*b''* of beam 1''. Alternatively, the fork can be lightened in said joining zone (FIG. 12) to provide a resilient retaining element 31 projecting toward the knurled wings 1*b''*.

As above mentioned, the holder according to the invention is able to collect loose-leaf sheet materials without holes. In this case, a folder 32 (FIG. 13), which is a prismatic container open only in its upper side, can be fitted on pin 6, 6'' of forks 3, 3', 3'', respectively.

What is claimed is:

1. A computer printout and document holding device adapted to contain a computer printout or document having a predetermined length and thickness, comprising:

a. a beam of a length not shorter than said predetermined length, said beam having at least one longitudinal upper guiding means and at least one longitudinal lower guiding means;

b. at least one sliding block having lower means for sliding along said upper longitudinal guiding means of the beam, and with other means for locking each said sliding block to the beam in any desired position, and for unlocking it therefrom, each said sliding block having an integral outwardly projecting hook adapted to be hookable and slidable along a suspension bar of a filing cabinet designed to house at least one holding device; and further comprising c. at least a pair of sliding support members for selectably supporting a printout or a document in a suspended condition, each of said support members including an upper longitudinal sliding means adapted so as to be slidably and frictionally engageable with the respective lower longitudinal guiding means of the beam, each support sliding means further including a lower downwardly projecting fork having two facing arms, parallel to each other and to the longitudinal axis of the beam and spaced apart from each other at a distance greater than said predetermined thickness, one of said arms at its upper end being integral with the body of the support member, and near the lower end thereof being integral with the head of a transverse first projecting pin which extends towards and beyond the other of said arms, said other arm having two portions, a first upper shorter portion integral with the body of the support member, and a second lower longer portion, pivotally connected to said first portion by means of a pivot pin, having an axis parallel to that of the said first pin, said second pivotable arm portion having a recess on one of its sides shaped and positioned so as to be engageable about the free end of the first pin which is accordingly provided with an annular groove, thereby supporting said printout or document.

2. A holding device according to claim 1, wherein the beam is an H-beam comprising two upper and lower pairs of parallel flanges connected by a vertical stem, said pair of parallel upper and lower flanges forming the upper and lower guiding means of the H-beam, said hook sliding block being provided at its lower part with a longitudinal recess shaped so as to form two inner facing grooves designed to receive said upper flanges of the H-beam, and each of the sliding support members being provided with an upper longitudinal recess shaped so as to form two facing longitudinal grooves provided so as to slidably receive the pair of lower longitudinal flanges of the H-beam.

3. A holding device according to claim 1, wherein each sliding block is provided with a vertical threaded through-hole in the lower means thereof, substantially positioned in the longitudinal vertical plane of said block, and designed to receive a locking screw.

4. A holding device according to claim 1, wherein one or the other of the lower guiding means of the beam or the upper sliding means of the support member is provided with a vertical hole housing a retaining spring device forming an elastic stop means, while in the other a plurality of notches or teeth are provided, designed to receive said stop means of the spring device, so that each support member can be moved along the beam in a step-by-step manner, as well as be frictionally stopped in any desired position.

5. A holding device according to claim 4, wherein the retaining spring device consists of ball, supported by a helical spring and partially projecting out of a vertical hole in said upper sliding means, in which said ball-spring device is inserted, while in said lower guiding means a series of substantially hemispherical notches equally spaced apart from each other, parallel to the beam axis, are provided.

6. A holding device according to claim 4, wherein the stop spring device consists of a series of transverse equally spaced apart teeth longitudinally arranged along a portion of said lower guiding means, while at said sliding means of each support member an elastic stop means is provided in the form of an elastic tab, projecting upwardly toward the series of facing teeth.

7. A device as defined in claim 1, characterized in that it is preferably made of plastics.

8. A device as defined in claim 13, and further comprising an upwardly opening folder for containing loose-leaf sheet material without holes, provided so as to be hookable to the forks.

* * * * *